US007999737B2

(12) United States Patent
Mäkinen et al.

(10) Patent No.: US 7,999,737 B2
(45) Date of Patent: Aug. 16, 2011

(54) BEAM ADJUSTING DEVICE

(75) Inventors: Jarmo Mäkinen, Vallentuna (SE); Olov Ekervik, Vallentuna (SE); Daniel Åkesson, Hässelby (SE)

(73) Assignee: Powerwave Technologies, Inc., Santa Ana, CA (US)

( * ) Notice: Subject to any disclaimer, the term of this patent is extended or adjusted under 35 U.S.C. 154(b) by 284 days.

(21) Appl. No.: 11/920,879

(22) PCT Filed: May 31, 2006

(86) PCT No.: PCT/SE2006/000641

§ 371 (c)(1),
(2), (4) Date: Nov. 21, 2007

(87) PCT Pub. No.: WO2006/130084

PCT Pub. Date: Dec. 7, 2006

(65) Prior Publication Data

US 2009/0040105 A1 Feb. 12, 2009

Related U.S. Application Data

(60) Provisional application No. 60/685,545, filed on May 31, 2005.

(30) Foreign Application Priority Data

May 31, 2005 (SE) ..... 0501235

(51) Int. Cl.
*H01Q 3/22* (2006.01)
*H01Q 3/00* (2006.01)

(52) U.S. Cl. ..... 342/375; 342/372

(58) Field of Classification Search ..... 342/81, 342/154, 368, 372, 373, 375
See application file for complete search history.

(56) References Cited

U.S. PATENT DOCUMENTS 5,623,270 A 4/1997 Kempkes et al.
5,801,600 A 9/1998 Butland et al.
6,198,458 B1 3/2001 Heinz et al.
(Continued)

FOREIGN PATENT DOCUMENTS

DE 20216431 3/2003
(Continued)

OTHER PUBLICATIONS

International Search Authority, Written Opinion for International Application No. PCT/SE2006/000641 dated Sep. 27, 2006, 4 pages.
(Continued)

*Primary Examiner* — Dao L Phan
(74) *Attorney, Agent, or Firm* — OC Patent Law Group

(57) ABSTRACT

The present invention relates to a device for adjusting the beam direction of an antenna. The device has a source connection terminal to be connected to a signal source and at least two feed connection terminals to be connected to antenna element feed points. A feed line structure is elongated in a main direction at a distance from and in parallel to a fixed ground plane on at least one side of said feed line structure, wherein a movable dielectric element is located between said feed line structure and said ground plane so as to change the signal phase of signal components being transferred between said source connection terminal and the respective feed connection terminals. The device includes means for allowing said ground plane to be positioned relatively close to said feed line structure without risking accidental contact between said feed line structure and said ground plane.

27 Claims, 4 Drawing Sheets

U.S. PATENT DOCUMENTS

| | | | |
|---|---|---|---|
| 6,850,130 | B1 | 2/2005 | Gottl et al. |
| 2001/0033247 | A1 | 10/2001 | Singer et al. |

FOREIGN PATENT DOCUMENTS

| | | | |
|---|---|---|---|
| EP | 0575808 | | 12/1993 |
| WO | WO-96/37922 | A1 | 11/1996 |
| WO | 98/21779 | | 5/1998 |
| WO | 01/03233 | | 1/2001 |
| WO | 01/24312 | | 4/2001 |
| WO | 02/37656 | | 5/2002 |
| WO | WO-02/35651 | A1 | 5/2002 |
| WO | 03/019723 | | 3/2003 |

OTHER PUBLICATIONS

International Search Authority, International Search Report for International Application No. PCT/SE2006/000641 dated Sep. 27, 2006, 3 pages.

Supplemental European Search Report pertaining to European Patent Application No. EP 06747835, mailed May 27, 2009.

BEAM ADJUSTING DEVICE

RELATED APPLICATION

This application claims priority to U.S. Provisional Application 60/685,545 filed May 31, 2005.

FIELD OF THE INVENTION

The present invention relates to a device for adjusting the beam direction of an antenna.

RELATED ART AND BACKGROUND OF THE INVENTION

Such devices are previously known from the documents WO 96/37922 (Allgon AB) and WO02/35651 A1 (Allgon AB). The device known from WO 96/37922 comprises a feed line structure integrated with a stationary array of antenna elements so as to enable adjustment of the direction of the beam radiated from the array. The feed line structure includes a feed conductor line pattern disposed on a fixed dielectric carrier plate at a distance from and in parallel to a fixed ground plate. The feed line structure is disposed on the carrier plate surface facing away from the ground plate. A movable dielectric plate is located between the carrier plate and the ground plate. The feed line pattern is elongated in the same direction as the movement direction of the dielectric plate. The propagation velocity of the signal components is reduced by the presence of the dielectric plate between the respective feed line and the ground plate. Accordingly, by displacing the dielectric plate in the longitudinal direction, the phase difference between the various signal components may be controlled. A problem with the device described in WO 96/37922 is that the influence on the signal phase, and thus the beam angle, is relatively low.

WO02/35651 A1 relates to a device for adjusting the beam direction of an antenna comprising a plurality of antenna elements coupled to a common signal source by means of a feed line structure consisting of punched metal lines. The feed line structure is extended in a main direction and positioned in parallel to one or two ground planes, wherein a movable dielectric element is located between the feed line structure and each ground plane in order to achieve a controlled phase shift to thereby adjust the beam direction of the antenna. The dielectric element consists of different portions having different effective dielectric values. A problem with the device described in WO02/35651 is mechanical tolerances.

A problem with both of the above described solutions, however, is that when a greater tilt angle interval is required, these devices get longer and bulkier which makes it hard to fit them in an antenna. Further, longer conductors are required, which increase losses.

Further, there exists a need for a solution having an improved RF performance and improved power durability.

AIM AND MOST IMPORTANT FEATURES OF THE INVENTION

It is an object of the present invention to provide a device for adjusting the beam direction of a beam radiated from a stationary array of antenna elements that solves the above mentioned problem.

The present invention provides a device for adjusting the beam direction of a beam radiated from a stationary array of antenna elements, wherein at least two antenna element feed points are coupled to a common signal source via a planar feed line structure having a source connection terminal to be connected to said source and at least two feed connection terminals to be connected to said antenna element feed points, said feed line structure being elongated in a main direction at a distance from and in parallel to a fixed ground plane on both sides of said feed line structure, wherein a movable dielectric element is located between said feed line structure and at least one ground plane so as to change the signal phase of signal components being transferred between said source connection terminal and the respective feed connection terminals, said dielectric element being movable in said main direction for effecting a controlled phase shift of said signal components so as to adjust said beam direction, wherein a non-conductive film or layer is positioned between said feed line structure and each ground plane.

It is a further object of the present invention to provide an antenna control system for adjusting the beam direction of a beam radiated from a stationary array of antenna elements that solves the above mentioned problem.

The present invention further provides an antenna control system for adjusting the beam direction of an antenna array, in particular of an antenna array constituting part of a base station in a mobile cellular communication system, said antenna comprising a plurality of antenna elements and phase shifting means for varying the phase of at least one signal being fed to said antenna elements, wherein adjustment of said phase of said signal is achieved by actuating an operating element, and wherein actuation of said operating element is achieved by operating an operating element actuator, wherein the phase shifting means comprises a device as described above.

The device for adjusting the beam direction of a beam radiated from a stationary array of antenna elements is characterised in that the device includes means for allowing said ground plane to be positioned relatively close to said feed line structure without risking accidental contact between said feed line structure and said ground plane. Said means may consist of a non-conductive film or layer positioned between said feed line structure and said ground plane.

Being able to arrange the feed line structure closer to the ground plane without the feed line structure and the ground plane accidentally coming into contact with each other, e.g. as a result of heat expansion of the feed lines, or presence of water drops, has the advantage that the device can be made considerably smaller as compared to the prior art, while at the same time keeping or improving the performance of the device and the range of the electrical tilt. This is particularly advantageous since mechanical tilt is prohibited in certain areas, which increases the demand on the range of the electrical tilt.

The present invention further has the advantage that the requirements of the feed line structure can be lowered, e.g. the structure can be made flexible since, due to the protection by the non-conductive film or layer, the flatness requirements of the feed line structure are substantially reduced or eliminated.

The relatively thin non-conductive film or layer may be positioned between said feed line structure and said dielectric element. Said feed line structure may further consist of a relatively thin conductive film or layer, and/or said non-conductive film or layer may be relatively thin.

This has the advantage that the non-conductive film or layer may function as a dielectric barrier, which in turn makes the device less sensitive of air gaps between the dielectric element and the feed line structure. Further, the non-conductive film or layer can provide a dielectric element sliding surface, which reduces friction, protects the feed line structure from wear and which secures the feed line structure from intermodulation. Consequently, no loss-related surface treatment of the feed line structure is necessary.

The feed line structure may be screen-printed onto the non-conductive film, or attached to the non-conductive layer or film, e.g. by gluing or bonding. Alternatively, the feed line structure may be etched on a printed circuit board (PCB), the PCB constituting the non-conductive film or layer. This has the advantage that a feed line structure with a small feed line thickness may be used as the feed line structure need not be self-supporting. Use of an ordinary PCB has the advantage that better tolerances and less costly manufacturing is achieved as compared to solutions of the prior art. Further, normal etch tolerances instead of punching tolerances may be used, which has the further advantage that it is considerably easier to manufacture optimal feed line patterns, e.g. meander shaped feed lines. Even further, mechanical stresses are reduced. Another advantage with this solution is an increased possibility to choose feed line impedance and shape, resulting in achievement of better RF performance. Further, a larger tilt range can be achieved, e.g. by meander shaped feed line(s). Also, due to the possibility of choosing feed line impedance, an unequal split of input power is easier to accomplish, thereby facilitating amplitude tapering.

Even further, the non-conductive film or layer is a better heat conductor than the surrounding air, which results in a device with a better power durability.

The device may be configured with at least four line segments extending from said source connection terminal to said feed connection terminals, with at least a first line segment and a second line segment extending generally in a first direction along said main direction, at least third and fourth line segment extending generally in a second direction being opposite to said first direction, wherein said dielectric element being located adjacent to at least part of said first and second line segments, and said third and fourth line segments, respectively, and having a effective dielectric value, wherein said dielectric element is linearly displaceable between two end positions while keeping said element in proximity to the respective pairs of oppositely extending line segments. This has the advantage that the device can be configured essentially as devices of the prior art.

A fixed ground plane may be arranged on both sides of said feed line structure, the feed line structure being parallel to said ground planes, wherein non-conductive films are positioned between said feed line structure and each ground plane, and wherein a dielectric element is positioned between each ground plane and each non-conductive film or layer. This has the advantage that the ground planes may be used as housing of the device, and the device may thus be made very compact. Further, since the present invention enables that the ground planes may be positioned close to the conductive layer, a wider range of feed line impedances may be used as, due to the shorter distance to ground, feed line impedance becomes more depending on the width of the conductors. Further, use of an etched feed line structure allows narrower feed lines as compared to the prior art, which accordingly increases the range of possible feed line impedances even further.

The dimensions of the non-conducting layer(s) may substantially correspond to the dimension of the ground plane(s). Further, at least one portion of the non-conducting layer(s) may be cut-out or cut-away so as to ensure that at least one well defined contact surface between the ground planes and/or feed line connection terminals can be established. Alternatively, the dimensions of the non-conductive film or layer may be such that the ground planes may contact each other at the edges along their entire length and width. This has the advantage that intermodulation may be suppressed and kept at a low level.

As stated above, at least one of said feed lines may be meander shaped. This has the advantage that a greater beam adjusting range may be obtained without increasing the length of the device, or even while reducing the length of the device.

The inner surface of said ground plane(s) may be anodized or provided with a non-conductive layer so as to provide an extra isolating layer. This has the advantage that the risk of undesired contact between feed line structure and ground plane, e.g. due to defects in the non-conducting film or layer, is reduced.

The non-conducting film(s) or layer(s) may have at least one of the further features: water repelling, temperature resistant, low RF losses, a dielectric constant that is lower than the dielectric constant of the dielectric element, low thermal expansion, high thermal conductivity, and a low absorption of moisture.

Commonly used materials, e.g., Teflon®, which is a trademark of E.I. Dupont, which is an isolating material with low $\in$ and low losses, may be used. Alternatively, plastic materials such as Ultem® or Lexan®, which are trademarks of the General Electric Company, may be used. Of course, other materials may be used as well.

The device is particularly suitable for use in an antenna control system for adjusting the beam direction of an antenna. In particular, the device is suitable for use in an antenna control system for remote setting of the tilt angle of a main lobe of an antenna array.

These and other features of the invention will become apparent from the detailed description below.

The invention will be explained more fully below with reference to the appended drawings illustrating some preferred embodiments.

DETAILED DESCRIPTION OF PREFERRED EMBODIMENTS

Figure 1:
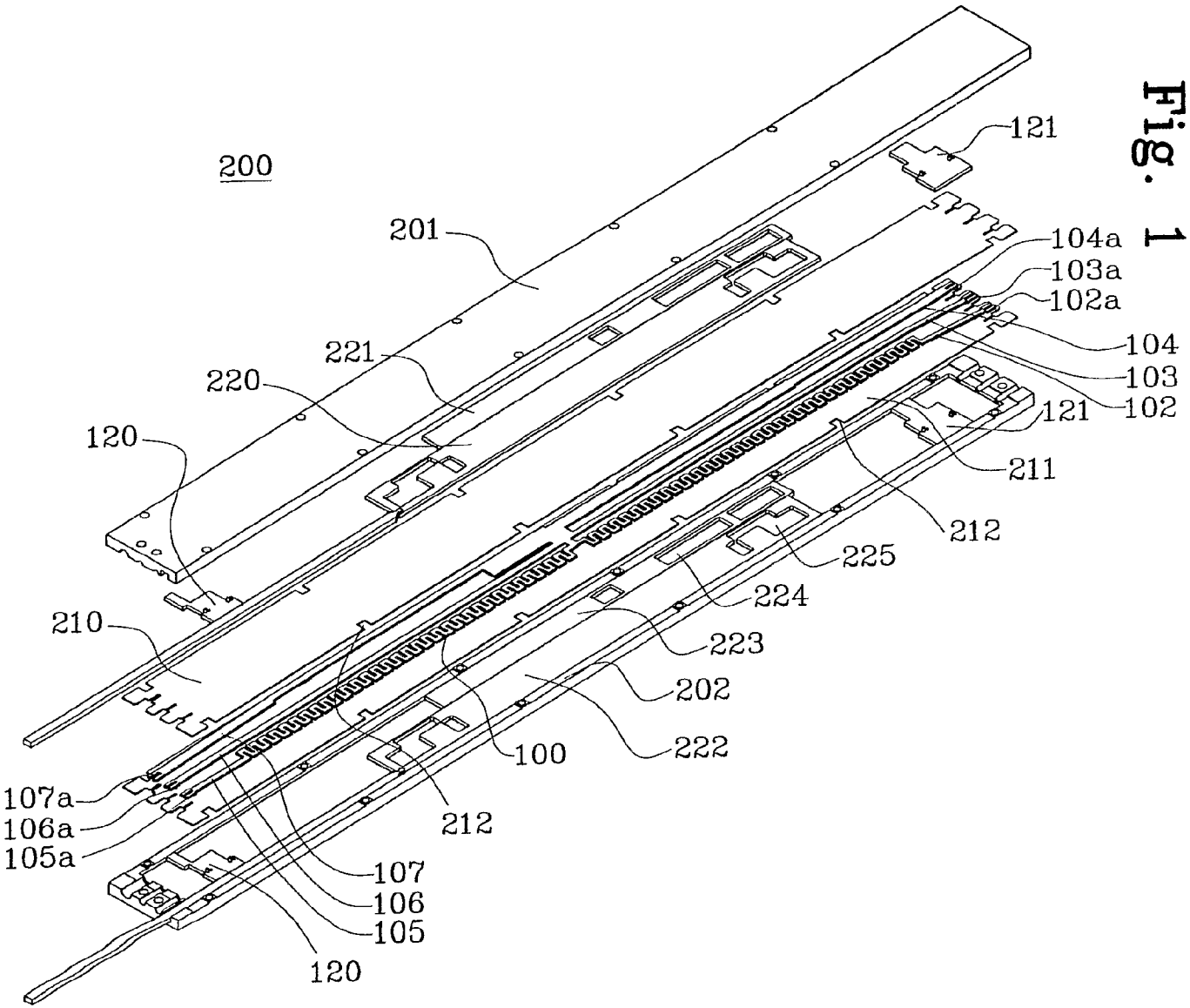
FIG. 1 shows an exemplary embodiment of a device according to the invention in an exploded view.
Figure 2:
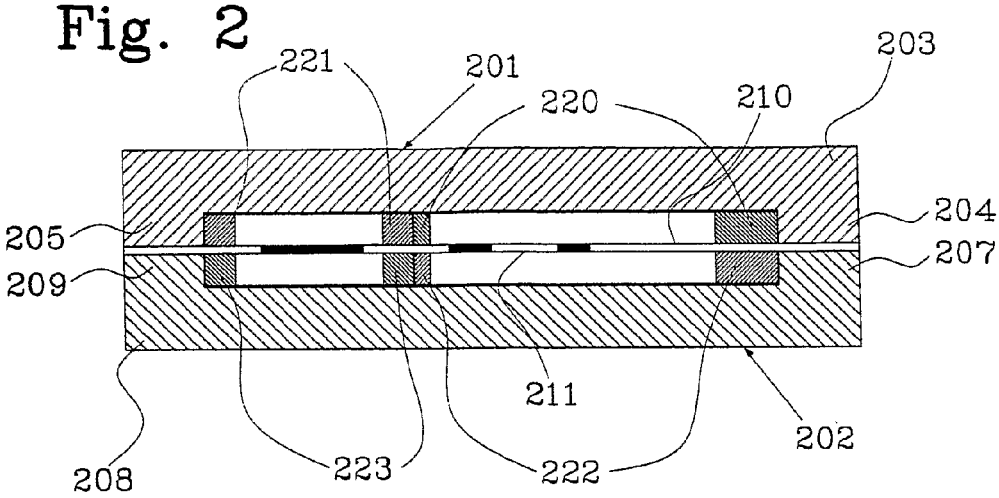
FIG. 2 shows the device of FIG. 1 in a sectional view.

In FIGS. 1 and 2 are shown an exemplary embodiment of the device 200 according to the present invention. In FIG. 1 is shown an exploded view of the device for adjusting the beam direction of a beam of an antenna. The device 200 comprises an elongated box-like housing consisting of an upper part 201 and a lower part 202, constituting ground planes. A feed line structure 100 is also shown. Each feed line segment 102-107 of the feed line structure is connected to an associated feed connection terminal 102*a*-107*a*. The feed connection terminals 102*a*-106*a* are connected, e.g. by coaxial cables (not shown), to associated antenna elements or sub-arrays, e.g. pairs of antenna elements, arranged in a stationary array, normally a linear row, in an antenna, e.g. a base station antenna. In use, the feed connection terminal 107*a* is connected, e.g. by a coaxial cable, to transceiver circuits (not shown), e.g. included in a base station of a cellular mobile telephone system.

Figure 3:
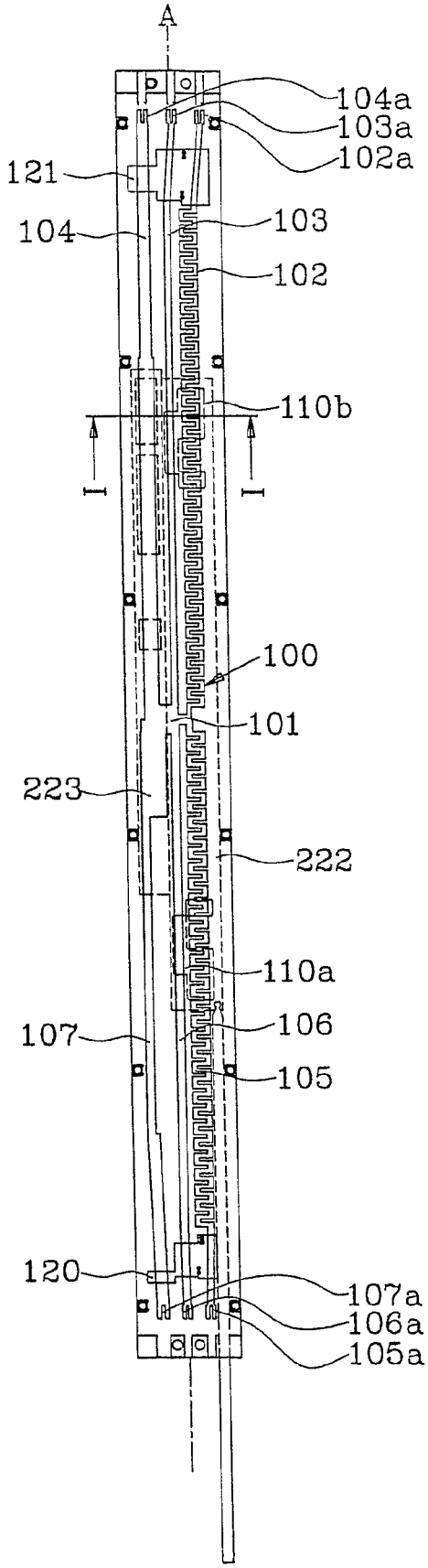
FIG. 3 shows the feed line structure of FIG. 1 more in detail.

In FIG. 2 is shown an expanded section of the assembled device along the line I-I in FIG. 3. As is shown in the figure, the upper part 201 includes a substantially planar top wall 203 and, integral therewith, two downwardly directed, longitudinally extending flanges 204, 205. The lower part 202 of the housing includes a substantially planar bottom wall 208 and, integral with the longitudinal edge portions of the bottom wall 208, upwardly directed flanges 207 and 209. The feed line structure 100 is arranged between two non-conducting films or layers 210, 211, the length and width of which substantially corresponding to the dimension of the upper and lower ground planes 201, 202, as can be seen in FIG. 1. The thickness of the non-conducting films or layers may be, e.g. in the order of 0.01-1 mm. This has the advantage that the non-conducting films or layers isolates the ground planes from each other, which has as result that intermodulation can be suppressed and kept at a low level. Further, a non-conducting film or layer having a dimension corresponding to the dimension of the upper and lower ground planes 201, 202 has the advantage that the upper and lower ground planes 201, 202 may constitute a mounting framework onto which the non-conducting film or layer can be affixed. The ground planes can be affixed to each other by fastening means, e.g. in form of screws in a manner known per se. In order to keep the ground planes isolated from each other, the screws may be of a non-conducting kind, e.g. plastic screws. Alternatively, ordinary (conducting) screws may be used, in which case the present invention has the advantage that only predetermined and distinct contact areas between the ground planes are used, which has intermodulation advantages. The non-conductive layers may have through-holes corresponding to the diameter of the screws, or, alternatively, the non-conducting layers may be provided with, preferably well-defined, cut-outs (indicated in FIG. 1 as 212) at the localisations of the affixing points. In order to facilitate the assembling of the device, the feed-line structure and the non-conducting layers can be glued together prior to the assembling. Alternatively, the feed line may be obtained by etching of a non-conducting film or layer comprising a conducting layer. The second non-conducting film or layer may then be attached, e.g. by gluing or bonding with prepreg, to the conducting-layer-side of the first non-conducting film or layer. As another alternative, one or both non-conducting films may be self-adhesive on one side, so that when the films are put together, with the feed line structure in-between, the films and the feed line structure is assembled to a unit that is easy to handle when assembling the device. In yet another embodiment, the non-conducting films or layers constitute a single film or layer in which the feed line structure is embedded. In the exemplary embodiment shown in FIG. 1, the feed line structure 100 is affixed to the non-conductive film 211.

Further, in FIGS. 1 and 2 are shown dielectric elements 220-223, which are used to influence the propagation velocity. Dielectric elements 221, 223 are optional and, if used, they can be used e.g. to reduce impedance in the feed conductors 104 and 107. Dielectric elements 220, 222 are used to influence the phase shift of the signal components being transferred along the respective line segments by being linearly displaceable along the longitudinal direction of the device between two end positions, as is known in the art, e.g. from WO02/35651 A1, and as will be explained further below, in order to change the phase angle differences between the signal components at the feed connection terminals. The phase angle differences will depend on the particular position of the dielectric element. When the dielectric element is displaced a certain distance, the transmission phases of line segments 102, 103, 105, 106 will be changed uniformly, while the transmission phase of line segment 104 remains substantially unchanged. If the phase shift of feed lines 102, 105 is twice that of the feed lines 106, 103, the phase angle difference between the terminals associated with adjacent antenna elements (or sub-arrays) will be mutually the same. Therefore, the composite beam from the five antenna elements coupled to these terminals will in such a case always have a wave front substantially in the form of a straight line, and the inclination of this wave front can be adjusted by displacing the dielectric element to a different position in the longitudinal direction of the device.

According to the invention, the dielectric elements may have different effective dielectric values, e.g. by providing part of the dielectric element with through-going holes, other irregularities or varying thicknesses in order to affect the retarding effect of the dielectric material. This is indicated in the figures, for example by the through-going holes 224, 225. Of course, the dielectric elements may be solid with equal dielectric values.

The dielectric elements can serve as spacing elements so as to keep the feed line structure in position. In an alternative embodiment, the top and bottom walls may be provided with positioning elements, e.g. in form of projections or walls, which may aid the dielectric elements in holding the feed line structure in position and ascertain a correct distance between the feed line conductors and the ground planes.

The use of the non-conductive layers has the advantage that the ground planes can be located close to the conductive layer without risking that the feed line conductors come into contact with the ground planes, e.g. due to water drops or due to deformations caused by heat expansion during use, with advantages as described above.

In an exemplary embodiment, the inner surface of the top and bottom walls and the flanges are anodized in order to provide an extra isolating layer for extra protection against undesired contact between the ground planes and the feed line structure. Instead of being anodized, the surfaces may be coated with a non-conductive coating.

In FIG. 3 is shown the feed line structure 100 of FIG. 1 more in detail. In the illustrated embodiment, the feed line structure 100 is configured with first and second line segments 105, 106 extending in a first direction, together with a feed conductor 107 along the main direction A of the device, and third, fourth and fifth line segments 102, 103, 104 extending in a second direction being opposite to the first direction. Each feed line segment is connected to an associated feed connection terminal 102*a*, 103*a*, 104*a*, 105*a* and 106*a*, respectively. The feed line segments are interconnected by a source connection terminal 101, which is connectable to a signal source by means of the feed conductor 107, and its associated feed terminal 107*a*. The feed connection terminals 102*a*-106*a*, are, as mentioned above, connected, e.g. by five coaxial cables, to associated antenna elements or sub-arrays.

A microwave signal appearing at the feed terminal 107*a* will propagate along the feed conductor 107 to the centrally located source connection terminal 101 and on to the five line segments 102-106. In order to adjust the down tilt, the displaceable dielectric elements 220, 222, of which 222 is indicated by dashed lines, partially covering the feed lines 102, 103, 105, 106, is slid along the feed lines in the main direction A. As is shown in the figure, the dielectric element 220 may be provided with through holes 110*a*, 110*b* in order to match the dielectrically loaded portions of the feed lines to the portions without dielectric loading. The dielectric element 223 is also indicated.

The device may further be provided with stationary dielectric elements 120, 121 (shown in FIGS. 1 and 3) near or at the ends of the device in order to match the impedance of the feed line segments to the connection terminals. As is shown in the figure, these may be of various shapes. The stationary elements may also have various thicknesses.

As is shown in the figure, the two feed lines 102, 105 are meander shaped. This has the advantage that a greater beam adjusting range can be obtained without increasing the length of the device. In an exemplary embodiment, the device could be made considerably shorter and at the same time provide a tilting angle interval twice as great as that of a prior art device.

Preferably, the dielectric material of the dielectric elements has a dielectric constant that is higher than the non-conductive film(s) or layer(s). A suitable material is Ultem®, or Lexan®, which are trademarks of the General Electric Company. In an exemplary embodiment, the dielectric constant of the dielectric material should be in the interval between 2 and 6 (the dielectric constant of the non-conducting film or layer should preferably be relatively low, e.g. $\leqq 3$). Further, the dielectric elements preferably should have, as the material of the non-conducting films or layers, low RF losses, be temperature-resistant, have a high thermal conductivity, have low absorption of moisture and have a low thermal expansion.

Figure 4A:
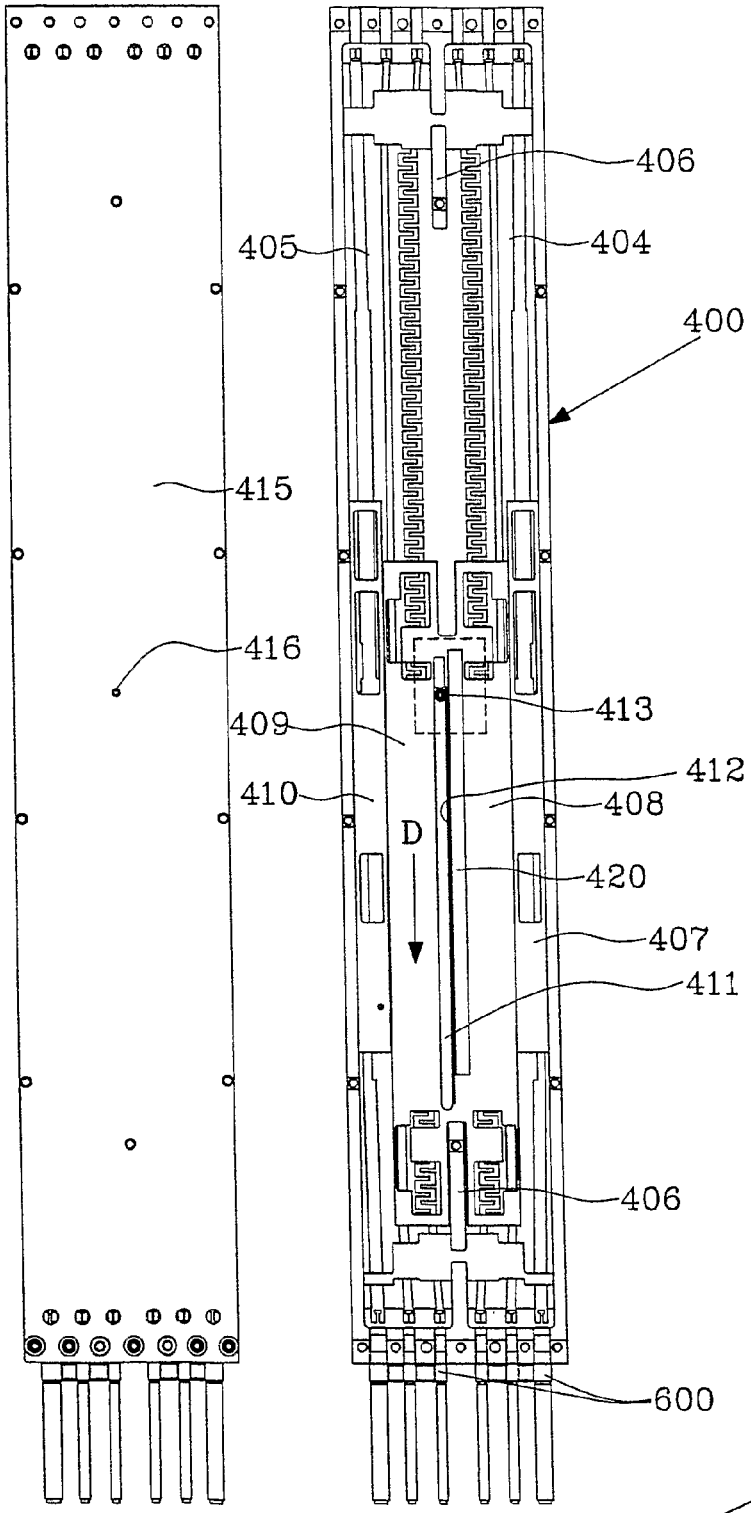
FIGS. 4*a*-*b* show an alternative exemplary embodiment of the present invention.

In FIG. 4*a* is shown an alternative exemplary embodiment of a device 400 according to the present invention, which is suitable for use with dual polarised array antennas or two separate antenna arrays. The structure of the device 400 regarding arrangement of ground planes, feed line structure, dielectric elements and non-conducting films or layers is similar to the device 200. In this embodiment, however, two feed line structures 404, 405 are enclosed in the housing. The feed line structures 404, 405 are separated by an intermediate flange 406, which has the function of the flanges 207, 209 described above. As can be seen in the figure, the intermediate flange 406 only extend along parts of the device in this embodiment, the reason for this will be explained below. As described above, each feed line structure 404, 405 is arranged between two non-conducting films or layers, the length and width of which, as described above, substantially correspond to the dimension of the upper and lower ground planes. Consequently, the two feed line structures may be positioned between the same non-conductive films or layers, the films or layers and feed line structures thus being manufacturable as a single component. Alternatively, each feed line structure may be positioned between separate non-conducting films or layers, each covering half the width of the device. In the latter case, the films and the feed line structure may be assembled to a single unit which is equally usable on the embodiment described in FIGS. 1-3 as in the embodiment described in FIG. 4*a*, thus providing manufacturing advantages.

Dielectric elements 407-410 (and, correspondingly, in accordance with the device 200, on the opposite side of the feed line structure, corresponding dielectric elements (not shown)) are used as described above, i.e. dielectric elements 408, 409 are used to influence the signal phase in the feed lines. The two feed line structures (and dielectric elements) in FIG. 4*a* are arranged such that the feed line structure 404 (and the dielectric elements 407-408) is a mirror of the feed line structure 405 (and the dielectric elements 409-410). This has as result that the two movable dielectric elements 408 and 409 are mirrored and positioned towards each other. Due to the fact that the intermediate flange only extends along part of the device 400, this solution allows the movable dielectric elements 408, 409 to, as is shown in the figure, be formed as an integral unit which, when moved, simultaneously influences the phase of signal components being transferred along respective line segments of the feed line structures 404, 405. Thus, the synchronous movement of the dielectric elements 408-409 (and corresponding (not shown), dielectric elements on the opposite side of the feed line structure) allows equal control of dual polarised antenna elements or different sets of antenna elements. For example, the dielectric elements 408-409 can be operated by a rod in a manner similar to the embodiment shown in FIGS. 1 and 3.

In the embodiment shown in FIG. 4*a*, however, an alternative exemplary solution to the movement of the dielectric elements is disclosed. The unit consisting of the dielectric elements 408, 409 is provided with a groove 411 of which one edge 412 constitutes a rack to, in a manner obvious and well known to a person skilled in the art, engage a toothed pinion 413 fitted within the groove. This solution is also shown more in detail in FIG. 4*b*, in which the pinion 413 is shown more in detail. As can be seen in the figure, the edge 412 of the dielectric elements 408, 409 engages the toothed pinion 413 such that when the pinion 413 is rotated, this movement is translated to a linear movement of the dielectric elements 408, 409. E.g., a clock-wise rotation of the pinion 413 results in the dielectric elements 408, 409 moving in the direction of arrows D. Consequently, the dielectric elements 408, 409 (and the equally toothed, corresponding dielectric elements on the opposite side of the feed line structure) can be moved simultaneously with perfect synchronisation in a simple manner. Further, the direct connection to the dielectric elements reduces transmission plays.

Figure 4B:
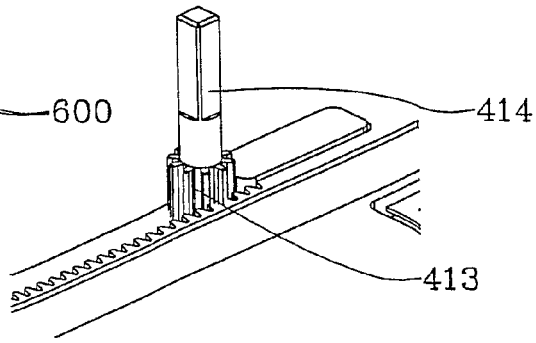

As can be seen in FIG. 4*b*, a shaft 414 of the pinion 413 extends through a hole 416 in the housing (ground plane) 415 so as to be engageable from the exterior of the housing 415. The shaft 414 may, for example, be connected directly to the shaft of a stepping motor, or, alternatively, be connected to a stepping motor via a worm gear. In particular the worm gear solution (or any toothed gear or angular gear solution for that matter) has the advantage that the dimension of the stepping motor can be made very small, at least if a suitable gear ratio is selected, as it only needs to provide torque enough to move the dielectric elements 408-409 (and corresponding elements as described above). This is a significant advantage as compared to the prior art, since the providing of sufficient power supply to the stepping motor and associated control electronics can be complicated. In the prior art, considerably larger components, such as rods and other linkage, have to be moved, which in turn requires a considerably larger power consumption. Both the stepping motor and its associated control electronics may advantageously be mounted inside the antenna radome.

In an alternative embodiment, the intermediate flange 406 may extend all along the device, the feed line structures thus being located in "separate compartments". In this solution, the edges of the dielectric elements 408, 409 facing each other may be embodied as racks, each for engagement with a toothed pinion. The toothed pinions may be provided in a recess in the intermediate flange and interconnected such that when one pinion is rotated, the other follows, however with each pinion only contacting the rack of one dielectric element. The pinions should therefore be offset somewhat with respect to a central axis extending through the intermediate flange. The interconnection ensures a synchronous movement of the pinions, and thus the dielectric elements. As is obvious to a person skilled in the art, the dielectric elements will move simultaneously in the same direction. As the pinions are interconnected, only the shaft of one pinion needs to be engageable from the exterior of the housing and the device can be operated as described above.

It is, of course, also possible to use both the above described solutions in a device according to FIGS. 1-3. For example, the toothed pinion could be positioned, e.g. at the right most portion of the device 200, in which case the right most sides of the movable dielectric elements 220, 222 would be formed as racks as described above.

FIG. 4*a* discloses a further feature of the present invention, which secures that a set beam tilt equals an intended beam tilt. The movable dielectric elements 408, 409 is provided with a reading scale 420 comprising a grading with a resolution of e.g. 1/100°. An optical reading device (not shown) is mounted on the exterior of the housing, directly above the reading scale 420 and scans the reading scale 420 through one or more openings in the housing. This has the advantage that an exact position of the movable dielectric element always can be obtained without, as in the prior art, having to detect the end positions of the movement of the dielectric element and then interpolate a desired tilt angle. Thus, it can be ensured that control signals sent from, e.g., a remote location to a stepping motor control electronics and comprising e.g. a SET TILT=22° command, will be executed in a correct manner.

As an alternative to the optical reading, the movable dielectric element may be provided with a linear potentiometer, whereby an exact position of the movable dielectric element can be obtained by measuring the resistance of the potentiometer.

Figure 5:
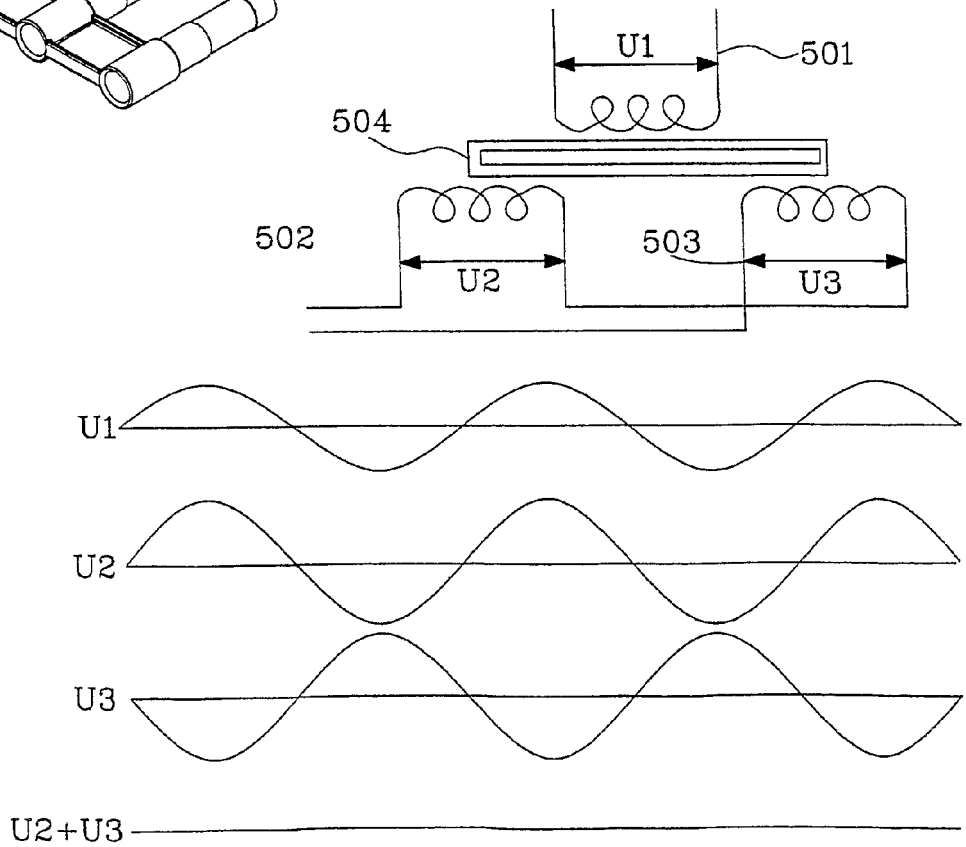
FIG. 5 shows a further feature of the present invention.

As yet another alternative to the optical reading, the reading may be performed by detecting a capacitance or an inductance. For example, a linear variable differential transformer (LVDT) may be used. Such a device may be obtained from RDP Electronics Ltd., and its principle of operation will be described below with reference to FIG. 5. Three coils 501, 502, 503 are wound onto a coil former or bobbin. Coil 501 constitutes a primary coil and is excited with an a.c. current, normally in the region of 1 to 30 kHz at 0.5 to 10V rms. The coils 502, 503 constitute secondary coils and are wound in opposition such that when a ferritic core is in the central linear position, an equal voltage is induced into each coil, and the outputs of the two secondary coils cancel each other out. By using a magnetic material movable part 504 as ferritic core, which in the present invention constitutes part of, is provided on, or connected to the movable dielectric element, movement of the movable part 504 induces currents into the coils 502, 503. As the movable part moves to the left (or right) in the figure, the induced voltage in coil 502 (503 when moving to the right) increases while the induced voltage in coil 503 (502) decreases. The magnitude of the output of the transducer (i.e., the sum of the induced voltages in coils 502, 503) rises linearly when the movable part displaced from the center, electrical zero position. Consequently, the exact position of the movable dielectric element can always be obtained by reading the output voltage. If the movable dielectric element can be moved in both directions from the center position, the phase of the output signal must be considered in order to know the direction of the movement.

As is obvious to a person skilled in the art, the described ways of controlling the actual beam tilt are applicable on all described embodiments.

Figure 6:
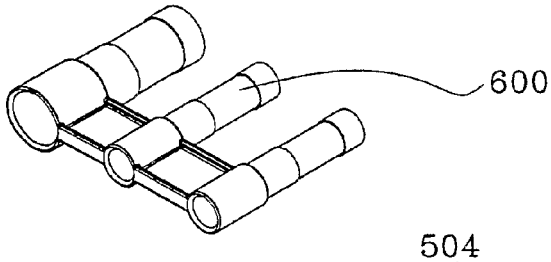
FIG. 6 shows another further feature of the present invention.

FIG. 4*a* also discloses a further advantageous feature of the present invention. A common problem with known phase shifters is that the respective cables to be connected to the device are soldered to the feed line terminals and housing. The soldering of a wire to the feed line terminals does not constitute a problem. However, the requirements of the soldering of the wire sheath to the housing are so rigorous, e.g. in order to control intermodulation, that, in practice, it is impossible to perform such soldering on site. Therefore, when a device is malfunctioning, there is no alternative but to replace the device and the cables soldered thereto. According to the present invention, however, the wire sheath of cables that are to be connected to the device are soldered to a cable shoe 600, shown more in detail in FIG. 6, in a controlled manner during the manufacturing process, and when the device is assembled, the cable shoe is releasably held in position by the screw joint of the upper and lower ground planes, and only the center conductor, the connection of which not being as critical as the ground connection, needs to be soldered to the device. In order to provide a satisfactory ground connection with controlled intermodulation without soldering, the cable shoe and/or the ground planes could be provided with an isolating layer, e.g. by anodization, to secure that a fully capacitive coupling of the ground is obtained. Consequently, a device can be disassembled and assembled and parts be replaced while the performance of the device is retained without having to perform precision soldering on site. As an alternative to the capacitive coupling of the ground as disclosed above, a conductive coupling may be used as well. In such a solution, a separate cable shoe for each cable may be used, and the cable shoe may be formed with an external thread and screwed into corresponding threads in the device housing. The cable shoe solution is, of course, also applicable on the device in FIGS. 1-3.

As also is obvious to a person skilled in the art, a number of other implementations, modifications, variations and/or additions can be made to the above described examples, and it is to be understood that the invention includes all such implementations, modifications, variations and/or additions which fall within the scope of the claims.

For example, the central source connection terminal may itself serve as a feed connection terminal for direct connection to an antenna element.

The proportions in the figures are for illustrative purposes only, and it is to be understood that in reality, the thickness of the dielectric elements may be considerably thinner, and, accordingly, the total thickness of the device also being thinner.

In the above described embodiment, the device includes five feed line segments. It is to be understood however, that the device may comprise more or less than five feed line segments, e.g. four or two.

The invention claimed is:

1. Device for adjusting the beam direction of a beam radiated from a stationary array of antenna elements, wherein at least two antenna element feed points are coupled to a common signal source via a planar feed line structure having a source connection terminal to be connected to said source and at least two feed connection terminals to be connected to said antenna element feed points, said feed line structure being elongated in a main direction at a distance from and in parallel to a fixed ground plane on both sides of said feed line structure, wherein a movable dielectric element is located between said feed line structure and at least one ground plane so as to change the signal phase of signal components being transferred between said source connection terminal and the respective feed connection terminals, said dielectric element being movable in said main direction for effecting a controlled phase shift of said signal components so as to adjust said beam direction, wherein a non-conductive film or layer is positioned between said feed line structure and each ground plane, wherein the dimension of the non-conducting film or layer substantially corresponds to the dimension of the ground plane.

2. Device according to claim 1, wherein a movable dielectric element is positioned between the feed line structure and each ground plane.

3. Device according to claim 2, wherein the non-conductive films or layers are positioned between said feed line structure and said dielectric elements, respectively.

4. Device according to claim 1, wherein said feed line structure consists of a relatively thin conductive film or layer, and/or said non-conductive films or layers are relatively thin.

5. Device according to claim 1, wherein said feed line structure is screen-printed onto a non-conductive film or layer, attached to the non-conductive film or layer, e.g. by gluing or bonding.

6. Device according to claim 1, wherein said feed line structure is etched on a printed circuit board (PCB), the PCB constituting a non-conductive film or layer.

7. Device according to claim 1, wherein the device is configured with at least four line segments extending from said source connection terminal to said feed connection terminals, with at least a first line segment and a second line segment extending generally in a first direction along said main direction, at least a third and fourth line segment extending generally in a second direction being opposite to said first direction, wherein said dielectric element being located adjacent to at least part of said first and second line segments and said third and fourth line segments, respectively, and having an effective dielectric value, and said dielectric element being linearly displaceable between two end positions while keeping said element in proximity to the respective pairs of oppositely extending line segments.

8. Device according to claim 1, wherein the device comprises two feed line structures.

9. Device according to claim 8, wherein the two feed line structures are interposed between the same non-conductive films or layers.

10. Device according to claim 1, wherein the feed line structure and said non-conductive films or layers constitute an integral unit, wherein the feed line structure is embedded in the non-conductive film or layer.

11. Device according to claim 1, wherein at least one portion of one or both non-conducting layers is cut-out or cut-away so as to ensure at least one well defined contact surface between ground planes and/or feed line connection terminals can be established.

12. Device according to claim 1, wherein at least one of said feed lines is meander shaped.

13. Device according to claim 1, wherein the inner surface of at least one ground plane is anodized or provided with a non-conductive layer so as to provide an extra isolating layer.

14. Device according to claim 1, wherein the non-conducting films or layers further has at least one of the following features:

water repelling, temperature resistant, low RF losses, a dielectric constant that is lower than the dielectric constant of the dielectric element, low thermal expansion high thermal conductivity, and low absorption of moisture.

15. Device according to claim 1, wherein the thickness of said non-conductive film(s) is in the interval of 0.01 mm to 1 mm.

16. Device according to claim 1, wherein said non-conductive films are made of a material of the group consisting of: Teflon®, plastic, Ultem®, Lexan® or any other low c materials that are suitable for RF applications.

17. Device according to claim 1, wherein said non-conducting films or layers are flexible.

18. Device according to claim 1, wherein the movable dielectric elements are provided with means for engagement with a pinion, so that a rotation of the pinion, causes a movement of the movable dielectric elements.

19. Device according to claim 18, wherein a shaft of the pinion extends through a ground plane so as to be engageable from the exterior of the device.

20. Device according to claim 1, wherein the device is provided with means for detecting the absolute position of the movable dielectric element so as to obtain a set beam tilt.

21. Device according to claim 20, wherein at least one of said movable dielectric elements is provided with a reading scale, and that an optical reading device is mounted on the exterior of the device to scan the reading scale through one or more openings in the device.

22. Device according to claim 20, wherein at least one of the movable dielectric elements is provided with a linear potentiometer, so as to allow an exact position of the movable dielectric element to be obtained by measuring the resistance of the potentiometer.

23. Device according to claim 1, wherein the device is arranged for receiving a cable shoe attached to a cable comprising a conductor and a sheath, so as to allow the sheath of the cable to be connected to the ground planes via the cable shoe by a capacitive coupling or a conducting screw joint.

24. An antenna control system for adjusting the beam direction of an antenna array, in particular of an antenna array constituting part of a base station in a mobile cellular communication system, said antenna comprising a plurality of antenna elements and phase shifting means for varying the phase of at least one signal being fed to said antenna elements, wherein adjustment of said phase of said signal is achieved by actuating an operating element, and wherein actuation of said operating element is achieved by operating an operating element actuator, wherein the phase shifting means comprises a device according to claim 1.

25. Antenna control system according to claim 24, wherein the operating element actuator consists of an electric motor with associated control electronics.

26. Antenna control system according to claim 25, wherein the electric motor is connected to the shaft of a pinion being engageable from the exterior of the device, wherein the movable dielectric elements are provided with means for engagement with the pinion, so that a rotation of the pinion by the electric motor, causes a movement of the movable dielectric elements.

27. Antenna control system according to claim 25, wherein the control electronics comprise input means for receiving command signals transmitted from a remote control unit, means for converting said command signal intended for the antenna unit into a corresponding control signal for said electric motor, and means for controlling said electric motor based on the control signal in order to displace the operating element so as to make a corresponding adjustment of said phase of said signal at each antenna element, thereby remotely controlling the general angular direction of said main lobe.

* * * * *